US011910857B1

(12) United States Patent
Buentello et al.

(10) Patent No.: US 11,910,857 B1
(45) Date of Patent: Feb. 27, 2024

(54) ARTICLE OF APPAREL PROVIDING SHELTER DURING A STORM

(71) Applicant: UIPCO, LLC, San Antonio, TX (US)

(72) Inventors: Andre Rene Buentello, San Antonio, TX (US); Nina Cooper, San Antonio, TX (US); Ashley Raine Philbrick, San Antonio, TX (US); Stacy Callaway Huggar, San Antonio, TX (US); Jose L. Romero, Jr., San Antonio, TX (US)

(73) Assignee: United Services Automobile Association (USAA), San Antonio, TX (US)

( * ) Notice: Subject to any disclaimer, the term of this patent is extended or adjusted under 35 U.S.C. 154(b) by 18 days.

(21) Appl. No.: 17/366,461

(22) Filed: Jul. 2, 2021

Related U.S. Application Data

(60) Provisional application No. 63/084,285, filed on Sep. 28, 2020.

(51) Int. Cl.
*A41D 3/08* (2006.01)
*A41D 31/10* (2019.01)
*A41D 31/28* (2019.01)

(52) U.S. Cl.
CPC ..... *A41D 3/08* (2013.01); *A41D 31/10* (2019.02); *A41D 31/285* (2019.02); *A41D 2200/10* (2013.01); *A41D 2200/20* (2013.01); *A41D 2300/33* (2013.01)

(58) Field of Classification Search
CPC ..... A41D 3/08; A41D 7/008; A41D 15/00; A41D 27/10; A41D 15/04; A41D 13/0007; A41D 27/12; A41D 27/16; A41D 19/0037; A41D 3/06; A45F 4/14; A45F 4/12; A61F 5/3784; A61F 5/3723; A47G 9/064; A47G 9/066; B60N 3/02
USPC ..... 128/874; 2/89, 456
See application file for complete search history.

(56) References Cited

U.S. PATENT DOCUMENTS 423,346 A * 3/1890 Sands ..... A41D 3/08 2/88
648,621 A * 5/1900 Hooper ..... A41B 13/06 5/494
2,198,577 A * 4/1940 Graham, Jr. ..... A41D 1/02 2/96
3,014,218 A * 12/1961 Smith ..... A41D 3/08 2/87

(Continued)

FOREIGN PATENT DOCUMENTS

GB 2394397 A * 4/2004 ..... A41D 7/008
KR 1140579 B1 * 5/2012 ..... A41D 13/1263

*Primary Examiner* — Sally Haden
*Assistant Examiner* — Grady Alexander Nunnery
(74) *Attorney, Agent, or Firm* — Plumsea Law Group, LLC

(57) ABSTRACT

An article of apparel for providing shelter to one or more people during a storm or other severe weather event is provided. In one embodiment, the article of apparel includes a cape. The article of apparel also includes at least one fastening mechanism. The at least one fastening mechanism including a pair of wrist cuffs configured to secure the article of apparel to a wearer. The article of apparel further including at least one securement mechanism. The at least one securement mechanism including a pair of arm straps. The pair of arm straps include a closure system configured to interlock the arm straps together in a locked configuration to secure the wearer to a stationary object.

20 Claims, 7 Drawing Sheets

(56) References Cited

U.S. PATENT DOCUMENTS

| | | | | | |
|---|---|---|---|---|---|
| 4,025,961 | A * | 5/1977 | Peters | A45D 44/08 | 2/88 |
| 4,451,932 | A * | 6/1984 | Wagemann | A61F 5/3784 | 128/874 |
| 4,782,534 | A * | 11/1988 | Grilliot | A62B 17/003 | 2/81 |
| 5,267,352 | A * | 12/1993 | Rodarmel | A41D 13/1245 | 2/243.1 |
| 5,412,813 | A * | 5/1995 | Hosley | A41D 13/00 | 2/243.1 |
| 5,662,372 | A * | 9/1997 | Lubkeman | A41D 3/08 | 296/136.04 |
| 5,996,121 | A * | 12/1999 | Harris | A41D 15/04 | 2/93 |
| 2005/0262613 | A1* | 12/2005 | Panek | A41D 15/04 | 2/89 |
| 2010/0127025 | A1* | 5/2010 | Kelling | A41D 15/04 | 2/243.1 |
| 2011/0179548 | A1* | 7/2011 | Weston | A45F 4/14 | 2/84 |
| 2014/0216512 | A1* | 8/2014 | Tallon | A45F 4/12 | 190/1 |
| 2014/0331381 | A1* | 11/2014 | Arajakis | A41D 3/005 | 2/84 |
| 2015/0150319 | A1* | 6/2015 | Walmsley | A41D 15/04 | 2/69.5 |

* cited by examiner

ARTICLE OF APPAREL PROVIDING SHELTER DURING A STORM

This application claims the benefit of U.S. Provisional Patent Application Ser. No. 63/084,285 filed on Sep. 28, 2020 and titled "Article of Apparel Providing Shelter During a Storm", the disclosure of which is incorporated by reference in its entirety.

BACKGROUND

The present embodiments relate to articles of apparel in general, and more particularly, to an article of apparel that provides shelter for one or more people during a storm or other severe weather event.

Extreme weather events, such as storms, severe rain and wind, and/or other natural disasters, can often occur without much advance warning. In particular, many geographic areas frequently experience extreme weather events on a regular basis. People facing these extreme weather events may not have sufficient time to seek out storm shelters or to evacuate the area in advance of a pending weather event. As a result, the storms or other extreme weather events may cause damage to buildings and other structures and high winds can further cause debris or other objects to fall onto or impact people sheltering inside their homes. As a result, injuries to people due to storm damage can be significant.

There is a need in the art for a mechanism that can assist with providing shelter to people during a storm.

SUMMARY

In one aspect, an article of apparel is provided. The article of apparel includes a cape. The article of apparel also includes at least one fastening mechanism. The at least one fastening mechanism including a pair of wrist cuffs configured to secure the article of apparel to a wearer. The article of apparel further including at least one securement mechanism. The at least one securement mechanism including a pair of arm straps. The pair of arm straps include a closure system configured to interlock the arm straps together in a locked configuration to secure the wearer to a stationary object.

In another aspect, a securement mechanism for an article of apparel is provided. The securement mechanism includes a first arm strap fixed to the article of apparel. The first arm strap is associated with an arm of a wearer of the article of apparel. The securement mechanism also includes a second arm strap fixed to the article of apparel. The second arm strap is associated with an opposite arm of the wearer. The securement mechanism further includes a closure system configured to interlock the first arm strap and the second arm strap in a locked configuration. The closure system including a first buckle located on a distal end of the first arm strap and a second buckle located on a distal end of the second arm strap. The first buckle and the second buckle having corresponding shapes that fit together. The arms of the wearer, the first arm strap, and the second arm strap form a loop when the closure system is in the closed configuration.

In another aspect, a method of using an article of apparel during an extreme weather event is provided. The method includes putting the article of apparel onto a wearer. The method also includes receiving one or more additional persons within an area under the article of apparel with the wearer. The method further includes encircling a stationary object using a fastening mechanism of the article of apparel. The method also includes engaging a closure system of the fastening mechanism to securely fasten the wearer of the wearer of the article of apparel to the stationary object.

Other systems, methods, features and advantages of the disclosure will be, or will become, apparent to one of ordinary skill in the art upon examination of the following figures and detailed description. It is intended that all such additional systems, methods, features and advantages be included within this description and this summary, be within the scope of the disclosure, and be protected by the following claims.

BRIEF DESCRIPTION OF THE DRAWINGS

The disclosure can be better understood with reference to the following drawings and description. The components in the figures are not necessarily to scale, emphasis instead being placed upon illustrating the principles of the disclosure. Moreover, in the figures, like reference numerals designate corresponding parts throughout the different views.

DETAILED DESCRIPTION

According to the principles of the example embodiments described herein, an article of apparel for providing shelter to one or more people during a storm or other severe weather event is provided. The article of apparel of the present embodiments provides a mechanism to securely fasten the wearer to a stationary object and to protect others within the article from falling objects or flying debris during an extreme weather event or natural disaster.

The example embodiments described herein provide an article of apparel in the form of a coat or jacket that can be used to help anchor one or more children in place when a parent and their children may be exposed to weather elements, (e.g., high winds, rains, hail, snow, etc.), falling objects, and/or flying debris during an extreme weather event or natural disaster. The child or children can be safely enveloped within the article of apparel for protection from the extreme weather event or natural disaster. The child or children may also be anchored to the article of apparel (and thus, to the parent) so that the children are not blown over by strong winds, for example. In some cases, the parent can anchor themselves to some form of stationary object, such as a tree, pole, support column, or other structure using a mechanism provided on the article of apparel.

As described herein, embodiments of an article of apparel for providing shelter to one or more people during a storm or other severe weather event may take different forms, including, but not limited to a coat, a parka, a jacket, or similar article of apparel that is configured to be worn by a wearer and to cover at least the wearer's arms and torso. In some embodiments, the article of apparel may further cover additional portions of the wearer's body, including the wearer's head and/or portions or all of the wearer's legs, including knees and/or ankles. In different embodiments, the article of apparel may have various lengths, such as waist-length, thigh-length, knee-length, or ankle-length. In other embodiments, the article of apparel may be a universal size configured to fit a variety of sizes and shapes of potential wearers. In still other embodiments, the article of apparel may be a full-body suit with optional wings or webbing that extends between the wearer's arms and legs.

Figure 1:
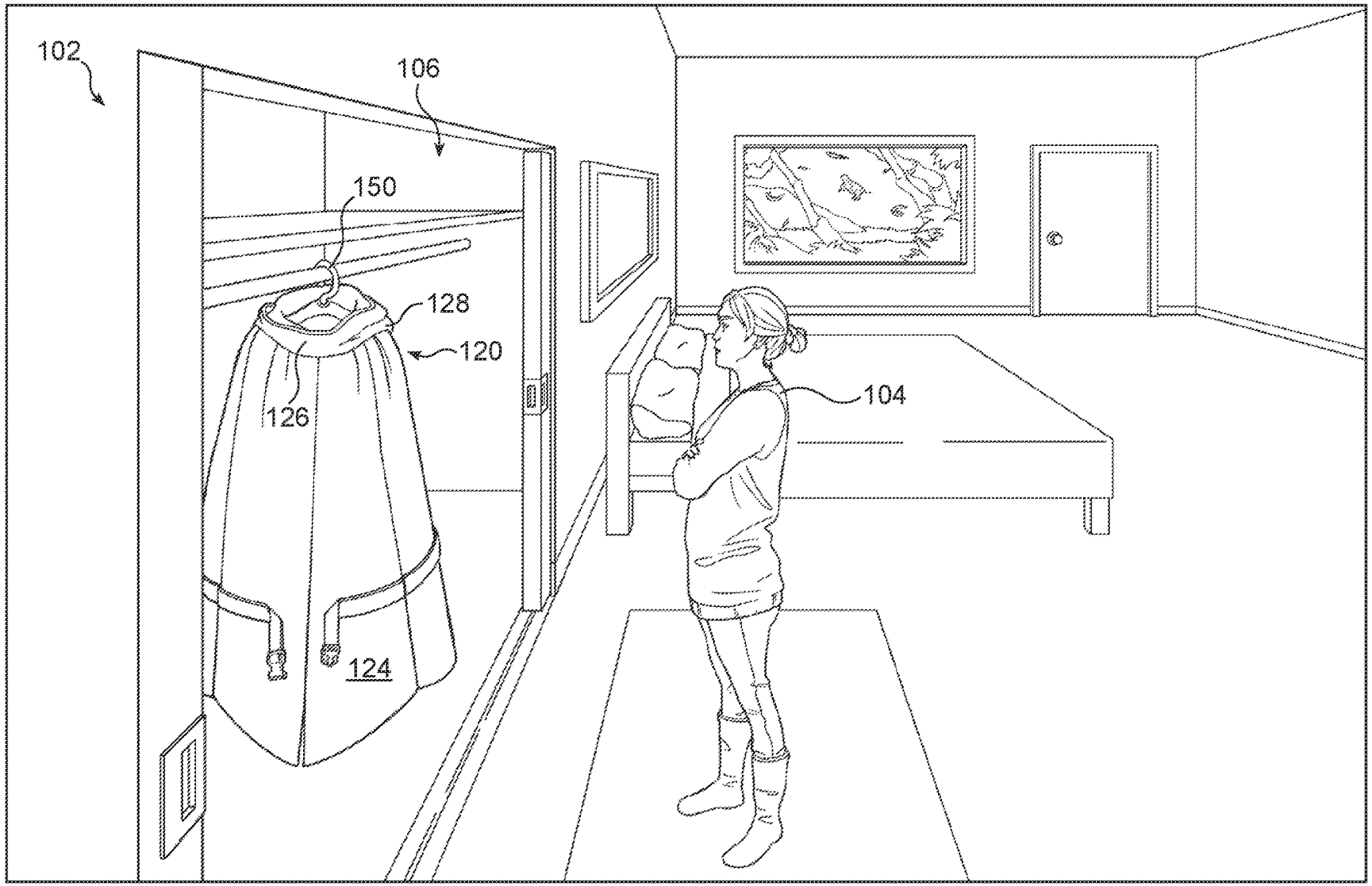
FIG. 1 is a schematic view of an example embodiment of an article of apparel for providing shelter during a storm stored in a closet of a home.

Referring now to FIG. 1, an example embodiment of an article of apparel 120 for providing shelter during a storm is shown stored in a closet of a home. In some embodiments, article of apparel 120 may be provided to one or more users who live in areas that are historically known to experience extreme weather events or natural disasters on a periodic or sporadic basis. For example, some geographic areas frequently experience tornados (e.g., geographic areas in the Midwest United States referred to as "tornado alley"), hurricanes (e.g., geographic areas near the Gulf of Mexico, the Caribbean, and along the east coast of the United States), and natural disasters such as earthquakes (e.g., geographic areas along fault lines, for example, parts of California). Users in these geographic areas may be provided with article of apparel 120 to keep stored in their home to use in the case of an extreme weather event or natural disaster. It should be understood, however, that article of apparel 120 may be provided to or obtained by users in any geographic area.

As shown in FIG. 1, article of apparel 120 is kept in a room 102 of a user 104, for example, in a closet 106, until such time that article of apparel 120 is needed for protection from a storm or other extreme weather event or natural disaster. In some embodiments, article of apparel 120 may be stored in proximity to user 104 so that it may be quickly put on when needed. In this embodiment, article of apparel 120 is kept on a coat hanger 150 inside closet 106 of room 102. In other embodiments, however, article of apparel 120 may be stored or kept in other locations until needed, such as folded up and stored in a dresser, under a bed, in a garage, etc.

In this embodiment, article of apparel 120 is in the form of a coat or overcoat that includes a cape 124. Cape 124 may be made of a material that is water-resistant and/or water-repellant and may also have impact-absorbing properties, such as one or more layers configured to dissipate forces from impacts or to provide padding or other cushioning material to protect the wearer from flying debris or falling objects during extreme weather event or natural disaster. Additionally, in some embodiments, cape 124 may be oversized so as to permit one or more additional persons to take shelter within an area under cape 124 (i.e., within the secured article of apparel 120).

In this embodiment, article of apparel 120 also includes a collar 126 and a hood 128. Collar 126 may be configured to extend around or encircle a neck of a wearer of article of apparel 120 and may provide a barrier to stop or reduce water and/or wind from getting inside the secured article of apparel 120 when worn by a wearer. Hood 128 is configured to extend over a head of a wearer of article of apparel 120 to provide protection from flying debris or falling objects during extreme weather event or natural disaster. In some embodiments, hood 128 may be made of a similar material as cape 124. In other embodiments, hood 128 may further include additional components to provide extra protection to the head of the wearer. For example, hood 128 may include a layer of a heat-resistant and strong synthetic fiber aramid, such as Nomex or Kevlar, or other ballistic-rated material.

It should be understood that in various other embodiments where article of apparel 120 has different forms, it may include different and/or additional components. For example, in embodiments where article of apparel 120 is in the form of a parka, coat, or jacket, it may include sleeves and/or a closure mechanism, such as a zipper, buttons, or both, to close article of apparel 120 around the wearer and/or one or more additional persons, such as a child or children of the wearer.

Figure 2:
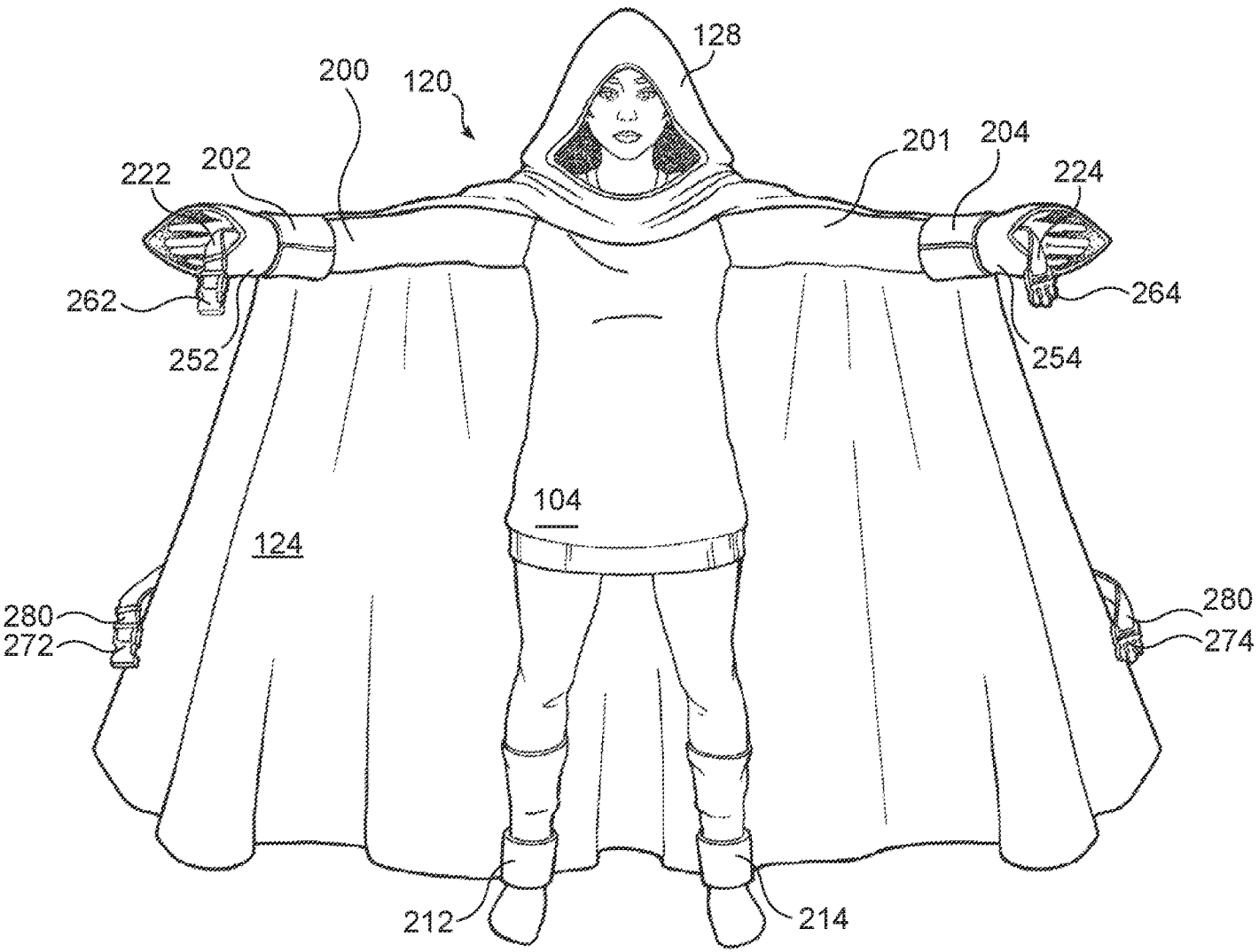
FIG. 2 is a schematic view of an example embodiment of an article of apparel for providing shelter during a storm being worn.

Referring now to FIG. 2, article of apparel 120 for providing shelter during a storm is shown being worn by a wearer. In this embodiment, user 104 has put on article of apparel 120 in advance of an impending or on-going storm or other extreme weather event and/or natural disaster. In some embodiments, article of apparel 120 may include one or more fastening mechanisms configured to secure article of apparel 120 to the wearer (e.g., user 104). In an example embodiment, article of apparel 120 may include a pair of wrist cuffs that encircle the wearer's wrists to secure article of apparel 120 to the wearer. In this embodiment, the pair of wrist cuffs include a first wrist cuff 202 configured to encircle a wrist of a right arm 200 of user 104 and a second wrist cuff 204 configured to encircle a wrist of a left arm 201 of user 104.

In some embodiments, the fastening mechanisms may further include a pair of ankle cuffs that encircle the wearer's ankles to secure cape 124 of article of apparel 120 to the wearer. In this embodiment, the pair of ankle cuffs include a first ankle cuff 212 configured to encircle an ankle of a right leg of user 104 and a second ankle cuff 214 configured to encircle an ankle of a left leg of user 104. With this arrangement, article of apparel 120 is secured to user 104 by the fastening mechanisms at user's wrists and ankles.

Each of the fastening mechanisms (e.g., first wrist cuff 202, second wrist cuff 204, first ankle cuff 212, and second ankle cuff 214) may be fixedly attached to article of apparel 120. For example, first wrist cuff 202 and second wrist cuff 204 may be sewn or otherwise bonded or attached to a top portion of cape 124 of article of apparel 120. Similarly, first ankle cuff 212 and second ankle cuff 214 may also be sewn or otherwise bonded or attached to a bottom portion of cape 124 of article of apparel 120. Additionally, each of the fastening mechanisms (e.g., first wrist cuff 202, second wrist cuff 204, first ankle cuff 212, and second ankle cuff 214) may include an attachment element, such as a hook and loop fastener, a zipper, button, or strap, configured to secure the fastening mechanism around the wearer's wrist and/or ankles.

In some embodiments, article of apparel 120 may also include one or more securement mechanisms configured to securely anchor the wearer of article of apparel 120 to a stationary object. In this embodiment, article of apparel 120 includes a first set of securement mechanisms associated with the arms of the wearer, for example, a first arm strap 222 associated with right arm 200 of user 104 and a second arm strap 224 associated with left arm 201 of user 104. In an example embodiment, first arm strap 222 and second arm strap 224 may be securely fixed to first wrist cuff 202 and second wrist cuff 204, respectively, using stitching or other form of bonding. In other embodiments, first arm strap 222 and second arm strap 224 may be opposite ends of a continuous strap that extends from first wrist cuff 202 to second wrist cuff 204 and may be securely fixed to article of apparel 120 using stitching or other form or bonding.

In some embodiments, article of apparel 120 may include another securement mechanism in the form of a belt 280 that is configured to securely close or seal article of apparel 120 once the wearer has anchored herself to a stationary object. Belt 280 extends around an outer perimeter or circumference of article of apparel 120. In an example embodiment, belt 280 may be securely fixed to article of apparel 120 using stitching or other form or bonding.

In an example embodiment, the securement mechanisms may include closure systems configured to interlock or connect opposite ends of the straps or belts so as to form a loop. In this embodiment, the closure systems are in the form of buckles. For example, first arm strap 222 includes a first buckle 262 at a distal end of first arm strap 222 and second arm strap 224 incudes a second buckle 264 at a distal end of second arm strap 224. In this example, first buckle 262 and second buckle 264 are corresponding or coincident shapes that are configured to interlock or connect to each other (i.e., male and female buckle receptacles). With this arrangement, user 104 may attach first buckle 262 to second buckle 264 to form a loop around a stationary object using first arm strap 222 and second arm strap 224.

In this embodiment, opposite ends of belt 280 also include a closure system in the form of buckles. For example, a third buckle 272 is located on belt 280 at one end and a fourth buckle 274 is located on an opposite end of belt 280. In this example, third buckle 272 and fourth buckle 274 are corresponding or coincident shapes that are configured to interlock or connect to each other (i.e., male and female buckle receptacles). With this arrangement, user 104 may attach third buckle 272 to fourth buckle 274 to form a loop around an outer perimeter or circumference of article of apparel 120 to securely close or seal article of apparel 120 once the wearer has anchored herself to a stationary object.

In other embodiments, different forms of closure systems may be used to interlock or connect ends of the securement mechanisms. For example, snaps, buttons, hook and loop fasteners, knots, or other closure systems may be used to interlock or connect opposite ends of the securement mechanisms to provide a secure anchor for the wearer to secure herself to a stationary object.

In some embodiments, article of apparel 120 may include additional components configured to provide protection to the wearer from the storm or other extreme weather event and/or natural disaster. For example, in this embodiment, article of apparel includes a pair of covers for the wearer's hands, including a first hand cover 252 configured to cover and protect the right hand of user 140 and a second hand cover 262 configured to cover and protect the left hand of user 140. First hand cover 252 and/or second hand cover 262 may be made of a similar material as cape 124, described above. In other embodiments, first hand cover 252 and/or second hand cover 262 may be made from different materials, including but not limited to a padded or cushioned material, such as foam, or from an inflexible or rigid material, such as plastic or other polymer, or combinations thereof.

Figure 3:
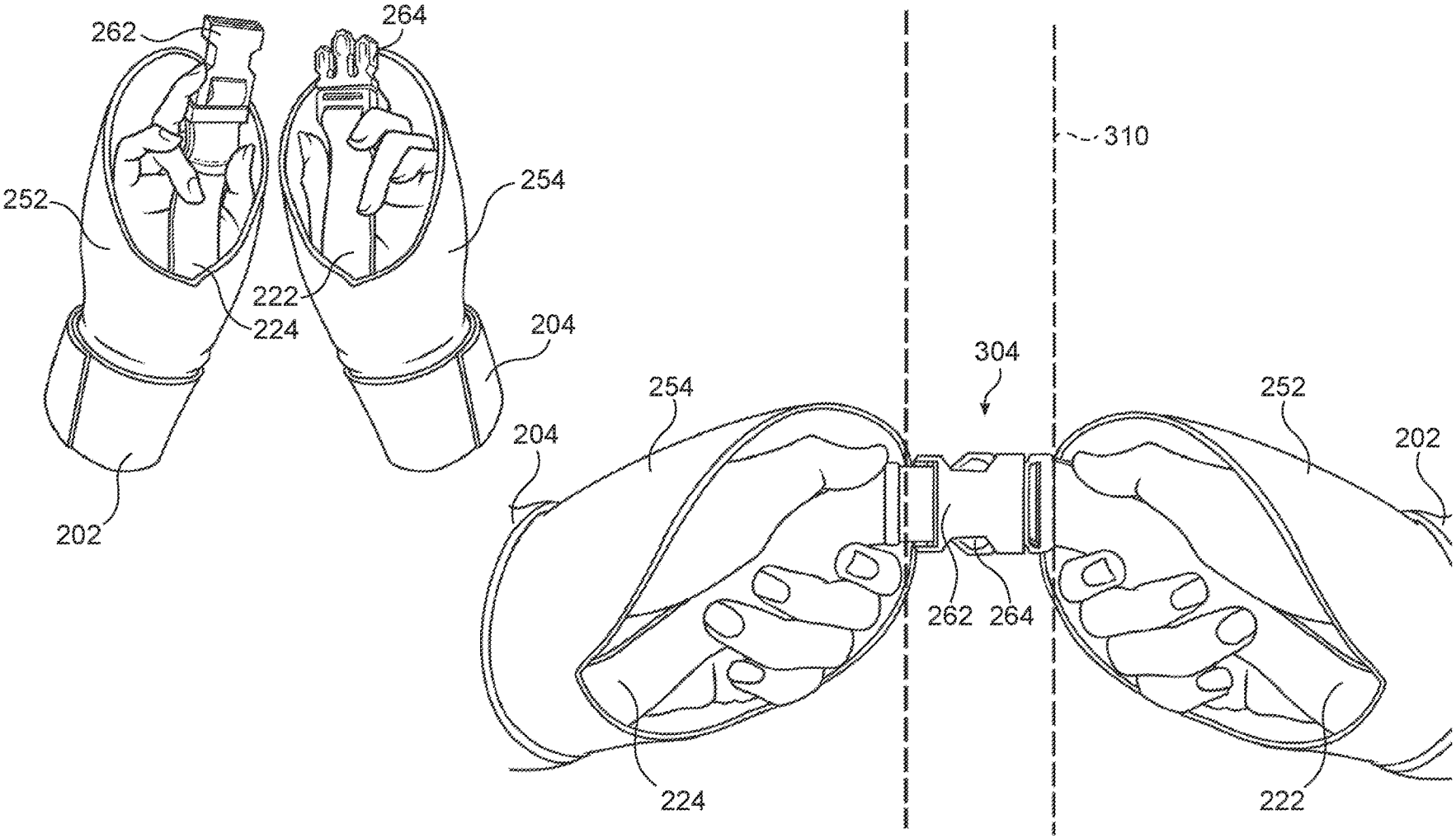
FIG. 3 is an enlarged view of an example embodiment of a securement mechanism of an article of apparel for providing shelter during a storm.

Referring now to FIG. 3, an enlarged view of an example embodiment of a securement mechanism of article of apparel 120 for providing shelter during a storm is shown. In some embodiments, a wearer of article of apparel 120 (e.g., user 104) may use one or more securement mechanisms to securely anchor the wearer to a stationary object. In an example embodiment, the securement mechanisms include first arm strap 222 extending from first wrist cuff 202 and second arm strap 224 extending from second wrist cuff 204. In this embodiment, first arm strap 222 and second arm strap 224 are shown with a closure system in the form of buckles, including first buckle 262 at the distal end of first arm strap 222 and second buckle 264 at the distal end of second arm strap 224.

In an example embodiment, the wearer of article of apparel 120 may use the closure system of the securement mechanism to securely anchor the wearer to a stationary object 310. In this embodiment, stationary object 310 is in the form of a pole or support column, for example, a pole or support column inside the wearer's home. In other embodiments, the stationary object may be any suitable object that is securely fixed into the ground or floor, including, but not limited to a pole, a support column, a tree, a post, and/or any other object fixed in place to a structure or a ground surface.

As shown in FIG. 3, the wearer of article of apparel (e.g., user 104) uses the securement mechanism (e.g., first arm strap 222 and second arm strap 224) by wrapping her arms around stationary object 310 to form a loop and then engaging the closure system (e.g., first buckle 262 and second buckle 264) to lock the securement mechanism in place around stationary object 310. In this embodiment, first buckle 262 and second buckle 264 are in a locked configuration 304 with corresponding or coincident shapes (i.e., male and female buckle receptacles) interlocked or connected to each other to secure the wearer of article of apparel to stationary object 310. In some embodiments, the closure system (e.g., first buckle 262 and second buckle 264) may be released by pressing second buckle 264 inward to release first buckle 262 and second buckle 264 from locked configuration 304.

Figure 4:
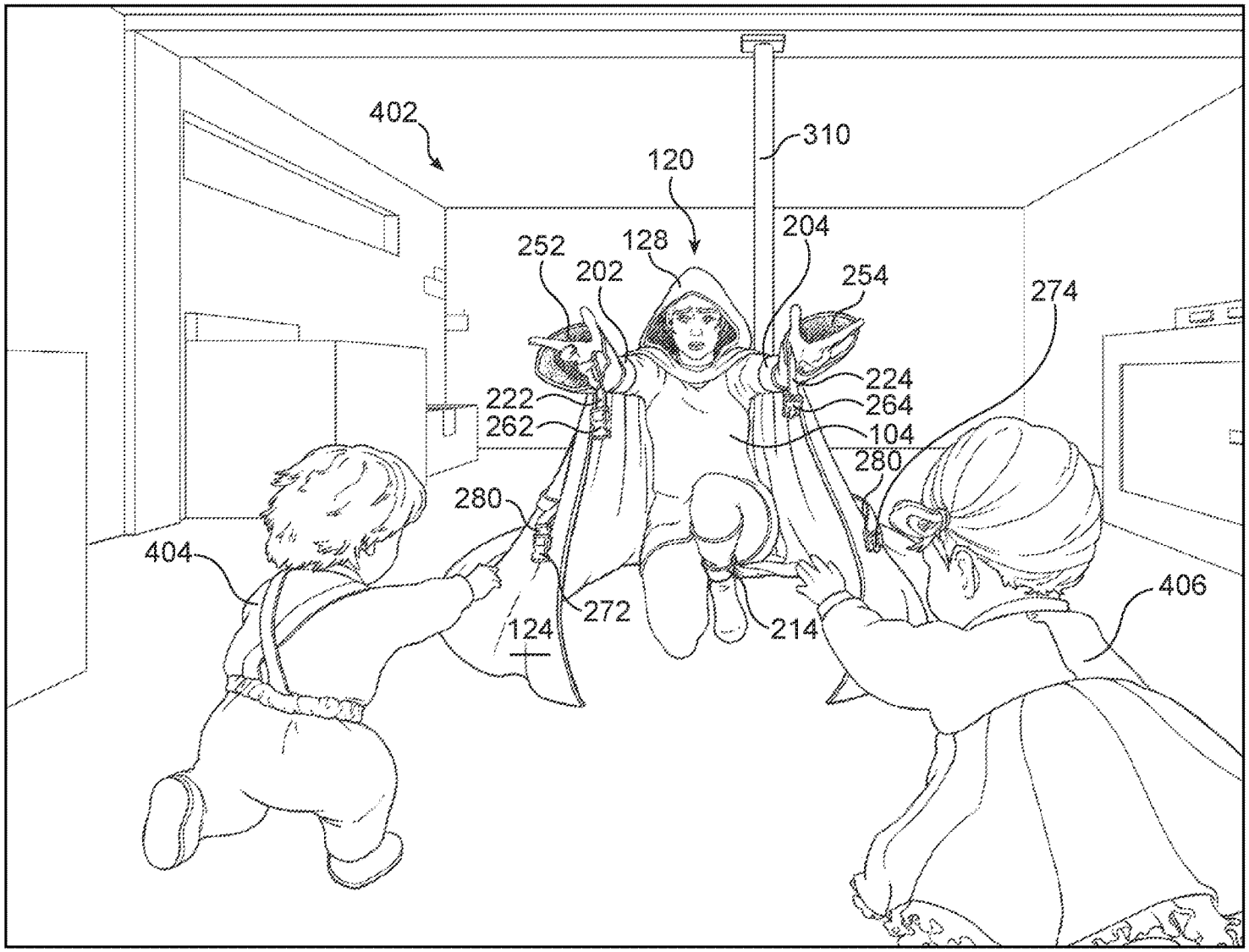
FIG. 4 is a representational view of an example embodiment of an article of apparel for providing shelter being used during a storm.

Referring now to FIG. 4, example embodiment of article of apparel 120 for providing shelter is shown being used during a storm. As described above, in some embodiments, article of apparel 120 may be used during a storm or other extreme weather event and/or natural disaster. In this embodiment, user 104 has put on article of apparel 120 in response to an imminent or ongoing extreme weather event or natural disaster, for example, a tornado or hurricane. As shown in FIG. 4, user 104 wearing article of apparel 120 is located in a storm shelter or basement 402 of the home of user 104.

In some embodiments, article of apparel 120 may be configured so that at least one additional person fits within an area under article of apparel 120, for example, under cape 124. For example, article of apparel 120 may be sized and dimensioned so that two average size adults or one average size adult and one or more children may fit under article of apparel 120. In this embodiment, article of apparel 120 worn by user 104 is configured to fit two additional persons (i.e., two children) under the area formed by cape 124 of article of apparel 120. As shown in FIG. 4, a first child 404 and a second child 406 are running towards user 104 wearing article of apparel 120.

Figure 5:
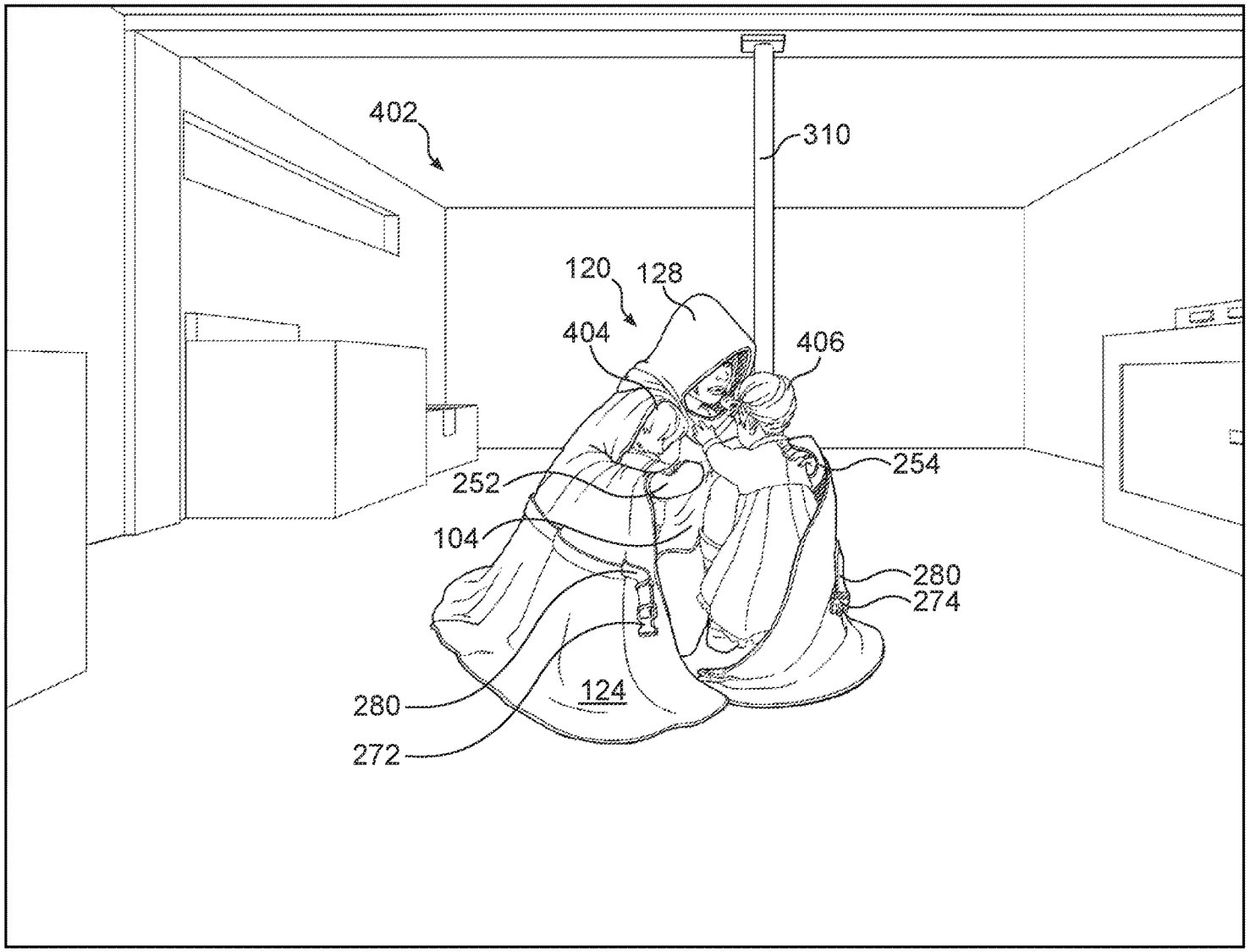
FIG. 5 is a representational view of an example embodiment of an article of apparel for providing shelter being used during a storm to protect additional people.

In this embodiment, the securement mechanisms (e.g., first arm strap 222, second arm strap 224, and belt 280) are in an unlocked or open configuration so that first child 404 and second child 406 may be received inside the area formed by cape 124 of article of apparel 120. Next, referring to FIG. 5, the children (e.g., first child 404 and second child 406) are shown being received inside the area under article of apparel 120 worn by user 104. Using article of apparel 120, one or more children, for example, first child 404 and/or second child 406, can be safely enveloped within article of apparel 120 for protection from the extreme weather event or natural disaster. In some embodiments, the child or children inside article of apparel 120 may also be anchored to article of apparel 120 (and thus, to their parent, user 104) so that the children are not blown over by strong winds, for example. After first child 404 and second child 406 are received inside article of apparel 120, user 104 may securely fasten the one or more securement mechanisms to stationary object 310.

For example, user 104 may close article of apparel 120 with first child 404 and second child 406 inside using belt 280 wrapped around the outer perimeter or circumference of article of apparel 120. Belt 280 includes a closure system in the form of third buckle 272 and fourth buckle 274 that may be attached or mated to each other to securely close or seal article of apparel 120. In addition, user 104 may also secure first arm strap 222 and second arm strap 224 by wrapping her arms around stationary object 310 and engaging first buckle 262 and second buckle 264, as described above in reference to FIG. 3. With this arrangement, user 104 wearing article of apparel may be use the securement mechanisms to anchor herself in place around stationary object 310.

Figure 6:
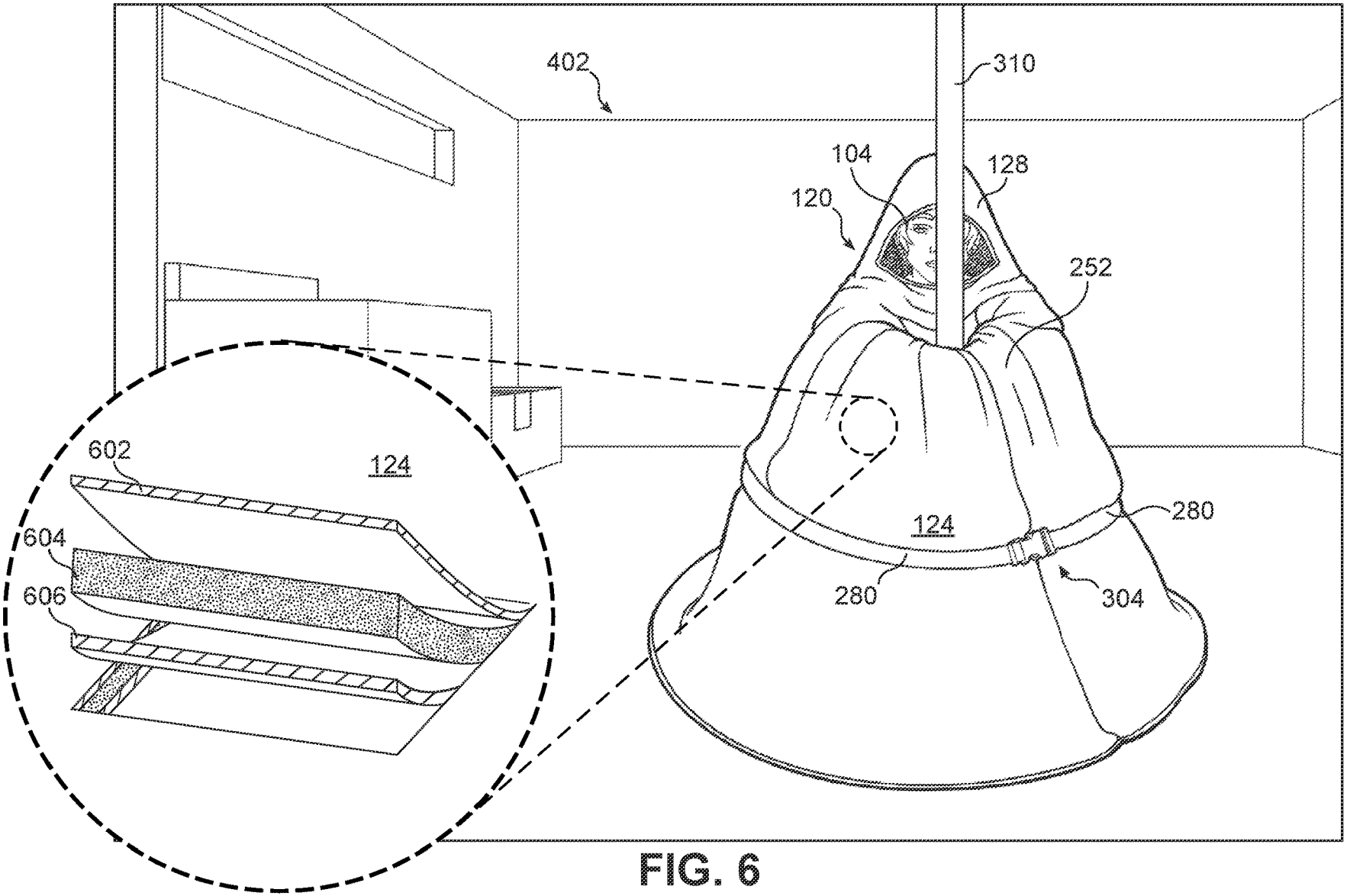
FIG. 6 is a schematic view an example embodiment of an article of apparel for providing shelter secured to a stationary object.

FIG. 6 shows article of apparel 120 secured to stationary object 310 in basement 402 of the home of user 104. In this embodiment, user 104 has engaged the closure systems of the securement mechanisms to locked configuration 304, for example, first buckle 262 and second buckle 264 of first arm strap 222 and second arm strap 224 and/or third buckle 272 and fourth buckle 274 of belt 280, to anchor herself and her children (e.g., first child 404 and second child 406) inside article of apparel 120 for protection from the imminent or ongoing extreme weather event or natural disaster. As shown in FIG. 6, user 104 has encircled stationary object 310 with the sleeves of article of apparel 120 and has raised hood 128 over her head for additional protection.

In some embodiments, one or more portions of article of apparel 120 may include multiple layers of materials. For example, as shown in FIG. 6, cape 124 of article of apparel 120 includes a plurality of layers. In an example embodiment, each layer of the plurality of layers may be formed from a different material having different characteristics or properties. For example, in this embodiment, the plurality of layers of cape 124 includes a first layer 602 associated with an exterior or outer surface of article of apparel 120, a second layer 604 associated with a middle or intermediate portion of article of apparel 120, and a third layer 606 associated with an interior or inner surface of article of apparel 120. In this example embodiment, each layer of the plurality of layers (e.g., first layer 602, second layer 604, and third layer 606) is made of a different material.

In some embodiments, first layer 602 may include a water-resistant and/or water-repellant material, such as fabrics including polyester, nylon, thermoplastic polyurethane wool, cotton, vinyl, and combinations thereof, and/or a water-resistant and/or water-repellant coating, such as oil, wax, resin, or other durable waterproof repellent (DWR) coating. With this arrangement, first layer 602 associated with the exterior or outer surface of article of apparel 120 may be made water-repellant or resistant to keep the wearer and any persons under article of apparel 120 dry from rain or water associated with the extreme weather event or natural disaster.

In some embodiments, second layer 604 may include a material having impact-absorbing properties, such as foam or other padding or cushioning material. With this arrangement, second layer 604 of article of apparel 120 may be configured to dissipate forces from impacts or to provide padding or other cushioning material to protect the wearer and any persons under article of apparel 120 from flying debris or falling objects during the extreme weather event or natural disaster.

In some embodiments, third layer 606 may include a material having water-wicking or absorbing properties, such as fabrics including cotton, polyester, wool, or other natural or synthetic fabrics. With this arrangement, the interior or inner surface of article of apparel 120 may be made to help keep the wearer and any persons under article of apparel 120 dry, warm, and/or comfortable during the extreme weather event or natural disaster.

It should be understood that a three layer article of apparel 120 is shown in this embodiment, however, other embodiments may have different numbers of layers, including more or less layers. For example, articles of apparel provided to users who live in colder climates may include additional layers for warmth and/or protection from snow or ice and articles of apparel provided to users who live in warmer climates may include lighter and/or more breathable layers for cooling and protection from sun or heat.

Figure 7:
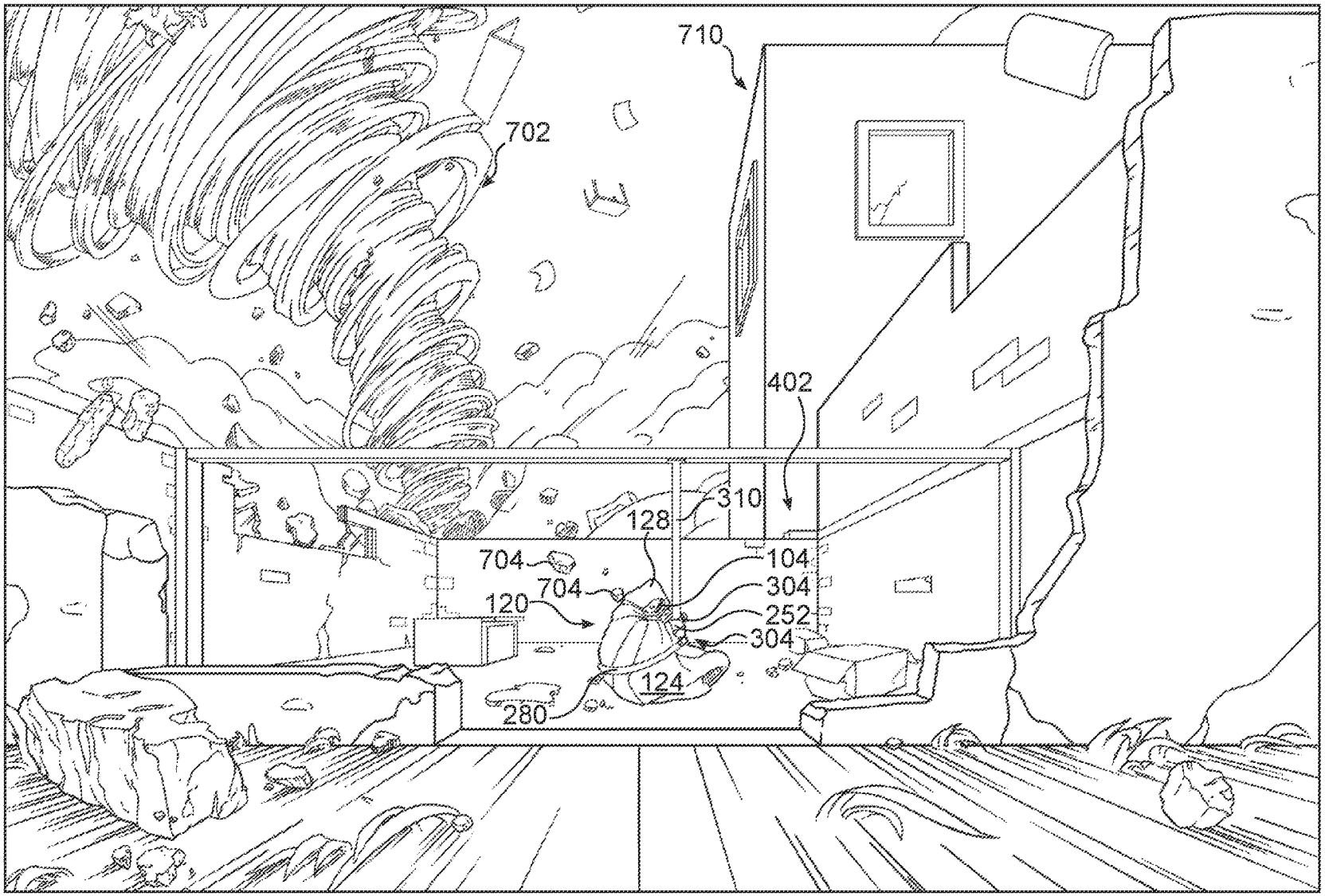
FIG. 7 is a representational view of an example embodiment of an article of apparel providing protection from flying debris during an extreme weather event.

FIG. 7 illustrates the example embodiment of article of apparel 120 providing protection from flying debris and falling objects during an extreme weather event. In this embodiment, the extreme weather event or natural disaster is a tornado 702. During the storm, tornado 702 may cause falling objects and/or flying debris 704 to impact user 104 wearing article of apparel 120. For example, as shown in FIG. 7, user 104 wearing article of apparel 120 has taken shelter in basement 402 and has anchored herself to stationary object 310, as described above, by engaging one or more of the securement mechanisms in locked configuration 304. As debris 704 from nearby buildings or structures, for example, a building 710, falls or is propelled by the winds of tornado 702 towards user 104, article of apparel 120 may help keep user 104 and/or her children (e.g., first child 404 and second child 406) protected underneath article of apparel 120.

While various embodiments of the disclosure have been described, the description is intended to be exemplary, rather than limiting and it will be apparent to those of ordinary skill in the art that many more embodiments and implementations are possible that are within the scope of the disclosure. Accordingly, the disclosure is not to be restricted except in light of the attached claims and their equivalents. Also, various modifications and changes may be made within the scope of the attached claims.

The invention claimed is:

1. An article of apparel, comprising:

a cape extending continuously from a collar configured to encircle a neck of a wearer of the article of apparel to a bottom portion of the cape configured to be located at or adjacent to ankles of the wearer of the article of apparel;

a first fastening mechanism including a pair of wrist cuffs configured to secure the article of apparel to the wearer along a top portion of the cape, the pair of wrist cuffs including a first wrist cuff associated with a right arm of the wearer and a second wrist cuff associated with a left arm of the wearer;

a second fastening mechanism including a pair of ankle cuffs configured to secure the bottom portion of the cape of the article of apparel to the wearer;

at least one securement mechanism comprising:

a continuous strap that extends between the pair of wrist cuffs, wherein the continuous strap is stitched to the article of apparel; and a pair of arm straps located at opposite ends of the continuous strap in an unlocked configuration, the pair of arm straps including a first arm strap extending out from the first wrist cuff and a second arm strap extending out from the second wrist cuff; and wherein the pair of arm straps include a closure system that interlocks the first arm strap and the second arm strap together in a locked configuration to form a loop with the length of the continuous strap to secure the wearer to a stationary object.

2. The article of apparel according to claim 1, further comprising a first hand cover configured to cover and protect the right hand of the wearer and a second hand cover configured to cover and protect the left hand of the wearer.

3. The article of apparel according to claim 1, further comprising a second securement mechanism including a belt configured to encircle an outer perimeter of the article of apparel over the cape.

4. The article of apparel according to claim 1, wherein the cape comprises a plurality of layers.

5. The article of apparel according to claim 4, wherein the plurality of layers comprises a first layer made of a water-resistant or water-repellant material and a second layer made of an impact-absorbing material.

6. The article of apparel according to claim 1, further comprising a hood extending from the collar, the hood configured to cover a head of the wearer.

7. The article of apparel according to claim 1, wherein the cape is configured to cover the ankles of the wearer.

8. The article of apparel according to claim 1, wherein the cape is configured to cover knees of the wearer.

9. The article of apparel according to claim 1, wherein the article of apparel is a universal size configured to fit wearers of different shapes and sizes.

10. The article of apparel according to claim 1, wherein an area under the cape is configured to fit at least one additional person.

11. A securement mechanism for an article of apparel, comprising:

a continuous strap comprising:

a first arm strap fixed to a first wrist cuff of the article of apparel, the first arm strap associated with an arm of a wearer of the article of apparel;

a second arm strap fixed to a second wrist cuff of the article of apparel, the second arm strap associated with an opposite arm of the wearer;

wherein the first wrist cuff and the second wrist cuff are directly attached to the article of apparel without sleeves;

wherein the continuous strap extends between the first wrist cuff and the second wrist cuff and wherein the continuous strap is stitched to the article of apparel;

a closure system configured to interlock the first arm strap and the second arm strap in a locked configuration, the closure system including:

a first buckle located on a distal end of the first arm strap extending out from the first wrist cuff; and a second buckle located on a distal end of the second arm strap extending out from the second wrist cuff, the first buckle and the second buckle having corresponding shapes that fit together, wherein the first buckle and the second buckle are located at opposite ends of the continuous strap in an unlocked configuration; and wherein the first arm strap and the second arm strap form a loop with the continuous strap when the closure system is in the locked configuration.

12. The securement mechanism according to claim 11, wherein the securement mechanism is configured to securely fasten the wearer of the article of apparel to a stationary object.

13. The securement mechanism according to claim 12, wherein the stationary object is a pole, a tree, a support column, or other object fixed in place to a structure or a ground surface.

14. The securement mechanism according to claim 12, further comprising a belt configured to cinch the article of apparel closed around the wearer and the stationary object.

15. A method of using an article of apparel during an extreme weather event, the method comprising:

putting the article of apparel onto a wearer using a first fastening mechanism in the form of a pair of wrist cuffs to attach a top portion of the article of apparel to wrists of the wearer and a second fastening mechanism in the form of a pair of ankle cuffs to attach a bottom portion of the article of apparel to ankles of the wearer;

receiving one or more additional persons within an area under the article of apparel with the wearer;

encircling a stationary object using a securement mechanism of the article of apparel, the securement mechanism including a continuous strap extending between a first arm strap extending out from a first wrist cuff of the pair of wrist cuffs and a second arm strap extending out from a second wrist cuff of the pair of wrist cuffs, wherein the first arm strap and the second arm strap are located at opposite ends of the continuous strap in an unlocked configuration, and wherein the continuous strap is stitched to the article of apparel; and engaging a closure system of the first arm strap and the second arm strap to form a loop with the continuous strap in a locked configuration to securely fasten the wearer of the article of apparel to the stationary object.

16. The method according to claim 15, further comprising retrieving the article of apparel from a storage area.

17. The method according to claim 15, further comprising closing the article of apparel with the one or more additional persons.

18. The method according to claim 15, further comprising using a belt extending around an outer perimeter of the article of apparel to secure the wearer around the stationary object.

19. The method according to claim 15, further comprising covering a head of the wearer with a hood of the article of apparel.

20. The method according to claim 15, further comprising using the article of apparel inside a building during the extreme weather event.

* * * * *